United States Patent [19]

Bruno

[11] 4,017,087

[45] Apr. 12, 1977

[54] AUTOMATIC GOLF BALL TEEING APPARATUS

[76] Inventor: Philip Bruno, 521 W. Hickory St., East Rochester, N.Y. 14445

[22] Filed: Nov. 6, 1975

[21] Appl. No.: 629,324

[52] U.S. Cl. ..... 273/201; 273/182 R

[51] Int. Cl.[2] ..... A63B 57/00

[58] Field of Search ..... 273/201, 202, 33, 179 B

[56] References Cited

UNITED STATES PATENTS

| | | | |
|---|---|---|---|
| 1,667,481 | 4/1928 | Lange et al. | 273/201 X |
| 1,785,150 | 12/1930 | Sousier et al. | 273/201 X |
| 1,972,894 | 9/1934 | Loeb | 273/201 |
| 2,295,599 | 9/1942 | Mozel | 273/201 |
| 2,331,237 | 10/1943 | Schaefer | 273/201 X |
| 2,838,313 | 6/1958 | Mozel | 273/201 |

*Primary Examiner*—Richard C. Pinkham
*Assistant Examiner*—T. Brown
*Attorney, Agent, or Firm*—Stonebraker, Shepard & Stephens

[57] ABSTRACT

Golf apparatus for driving ranges and the like. A piston moves upwardly and downwardly in a cylinder below the ground level. Successive golf balls are taken one at a time from a supply of such balls, and raised by the piston either to turf level or to a tee level at an elevation somewhat above the turf level. When the ball is hit by a club, the decrease in weight against a pressure-sensitive switch carried by the piston, serves to close the switch to start an electric motor through the next cycle of operation. An adjustment is provided for determining whether the ball is to be raised only to the turf level, or all the way to the tee level. The adjustment feature of the apparatus also includes a control mechanism which serves to keep the pressure sensitive switch closed and keep the motor operating during the entire cycle of operation, notwithstanding that the weight of the ball during the upward travel from ball loading position to hitting position of the tee would tend to close the switch and stop the motor, if this control mechanism were not provided.

8 Claims, 6 Drawing Figures

AUTOMATIC GOLF BALL TEEING APPARATUS

BACKGROUND OF THE INVENTION

This invention relates to apparatus for placing a golf ball in position to be hit by a golf club, and is especially useful in golf driving ranges, where people hit a large number of golf balls, either for the sake of practice, or for mere amusement. Various forms of apparatus for this same general purpose are known in the art, and are disclosed, for example, in the following U.S. Pat. Nos:

| | | |
|---|---|---|
| 1,695,006 | 1928 | Brockhagen |
| 2,295,599 | 1942 | Mozel |
| 2,530,698 | 1950 | Hogenberg |
| 3,294,402 | 1966 | Scott |
| 3,778,067 | 1973 | Gentiluomo |

The purpose of the present invention is to provide a device which is, in at least some respects, more simple and inexpensive to construct, easier to maintain, easier to adjust, and more reliable in operation, as compared with the prior art devices.

SUMMARY OF THE INVENTION

According to the preferred embodiment of the invention, a vertical cylinder is mounted with its top end at approximately the turf level. A piston moves upwardly and downwardly in this cylinder, being operated by a link or connecting rod pivotally connected at one end to the piston, and at the other end to a crank arm on an electric motor. On the top of the piston there is mounted a golf tee member, carried bodily with the piston during the upward and downward movements of the piston, and also having a limited vertical movement relative to the piston. A snap-action microswitch carried by the piston has a spring arm which tends to support the tee member at a slight elevation relative to the piston when there is no additional weight of a golf ball on the tee member, and in this position, the switch is closed so that the motor runs. When a ball is on the tee member, however, the additional weight of the ball moves the tee member slightly downwardly relative to the piston, depressing the switch arm to open the switch so that the motor stops.

At the bottom of the downward stroke of the piston in the cylinder, the piston trips a detent or gate member, allowing another golf ball from a supply tube to enter the cylinder and drop onto the top of the tee member, but at this time a control plunger holds the switch in the upper position, so that the switch is open and the motor continues to run to raise the piston. During the upward travel, the control member, mounted on and movable bodily with the piston, reaches a recess in the side wall of the cylinder and moves into this recess so that the switch arm can move downwardly under the weight of the tee member and ball thereon, opening the switch and stopping the motor, leaving the ball on the tee in the desired location, ready to be hit by the golf club.

For adjusting the device so that balls may be moved either to a turf position or to a tee position, there are two recesses in the side wall of the cylinder, and means is provided for closing selectively one or the other of these recesses, to control the extent to which the tee member and ball thereon will be raised before the switch is opened and the motor is stopped. When the upper recess is effectively closed and the lower recess is open, the upward travel of the piston will be stopped when the control member reaches the open lower recess, and in this position, the ball, although still resting on top of the tee member, is at turf level. When the ball is hit by the club, and driven from this position, the switch will close, and the motor will resume operation, moving the piston on upwardly to its upper limit of motion (but with no ball thereon) and then immediately bringing it down again to the lower position, to pick up a fresh ball, whereupon the cycle is repeated. However, if the lower recess in the side wall of the cylinder is effectively closed and the upper recess is open, the control member cannot move into the lower recess as the piston goes up, and the travel continues to the upper limit of motion, at which point the control member does enter the recess, allowing the switch to open and the motor to stop, with the ball in an elevated or teed position. Then when the club removes the ball from the top of the tee, the lessened weight causes the switch to close and the motor to resume operation.

DESCRIPTION OF THE PREFERRED EMBODIMENT

Figure 1:
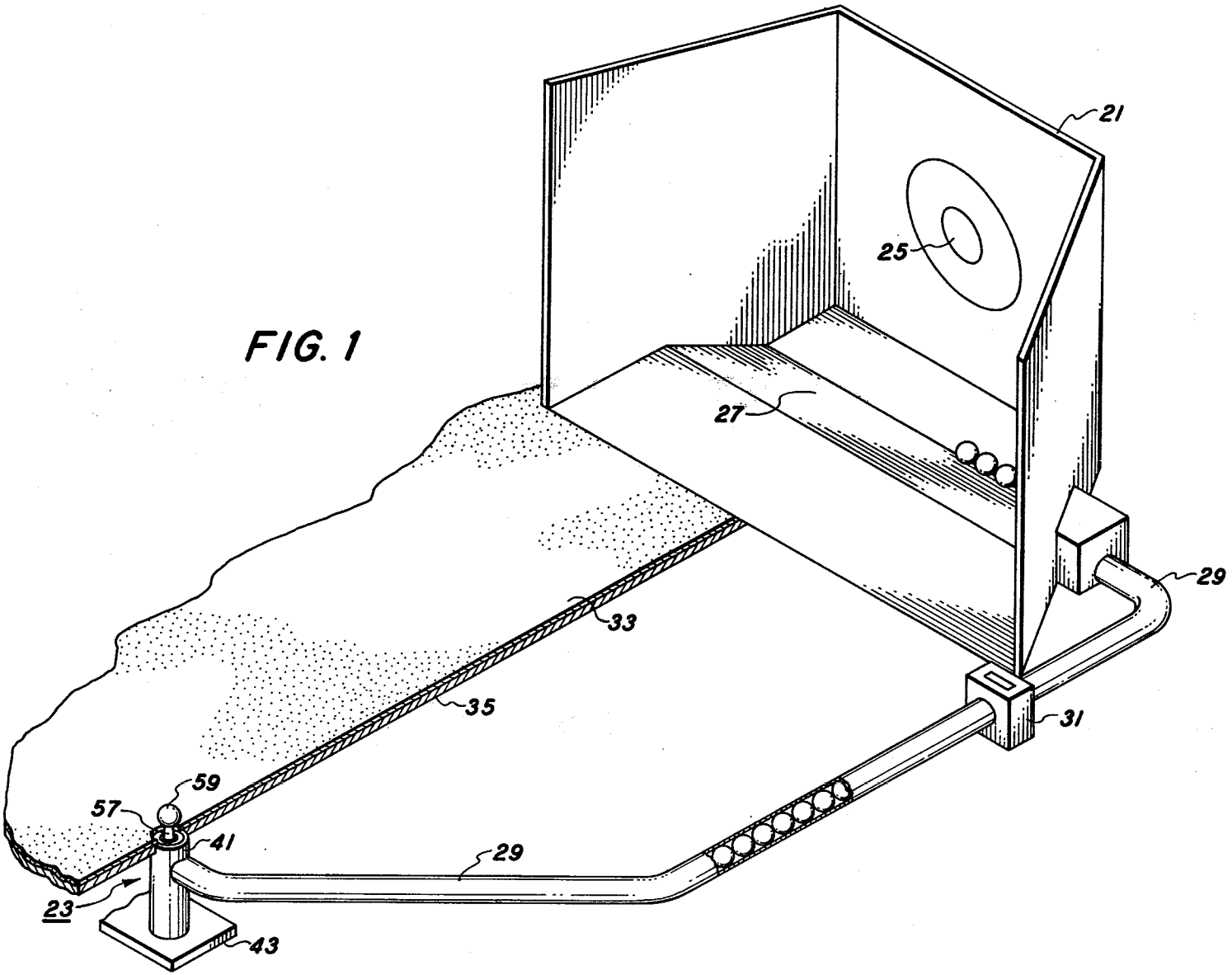
FIG. 1 is a perspective view of a preferred arrangement according to the present invention.

In the accompanying drawings, FIGS. 2–6 relate to details of the ball-feeding apparatus, while FIG. 1 shows the general environment of a preferred form. It should be understood, of course, that the ball-feeding apparatus may be located anywhere, as for example, in an open field, wherever a supply of balls can be provided by a suitable inclined tube. Where space is very limited, however, and there is no open field available, the apparatus is useful in even quite cramped quarters, by using a backstop, as shown at 21 in FIG. 1, which may be erected even quite close to the feeding apparatus which in generally is indicated schematically at 23. The golfer practicing his shots attempts to drive balls toward the bullseye 25 on the back wall of the backstop 21, which backstop may be padded in any suitable way or formed of absorbent material to prevent balls from ricocheting and hitting the golfer himself or other observers in his vicinity. The balls drop into a shallow trough 27, from which they are conducted by gravity to the feeding tube 29, possibly going through a coin-controlled device indicated schematically at 31, if desired, whereby the player, by dropping a coin into the device 31, may be supplied with a predetermined number of balls.

The balls permitted by the device 31 (if such a coin-controlled device is used) continue on through the gravity feed tube 29 to the golf teeing or feeding part of the mechanism, shown schematically and in general at 23, as aforesaid. This device is suitably mounted with its top edge near the level of the turf 33, which may be either natural or artificial turf, supported as for example by a support plate 35.

The apparatus includes a main stationary cylinder 41 (FIGS. 2–5) with its axis vertical and with its upper end flush or approximately flush with the turf 33. The cylinder is supported on any suitable support frame or plate such as shown at 43 in FIG. 2. Vertically movable within this cylinder is a piston comprising an outer sleeve 45 slidable in the cylinder 41, and an inner member 47 held stationary within the sleeve 45, as by screws or welding or other suitable means. The members 45 and 47 may be made integrally as a single piece, if desired, but for convenience of manufacture it is usually desirable to form them as separate pieces. At any rate, when assembled, they are fixed to each other and move together as a unit.

The member 47 has a top wall 49 in which there is a central vertical bore slidably receiving a stem 51 projecting downwardly from a plate 53 secured, as by cement or the like, to the flat bottom surface of the tee member 55 which has a ball-supporting portion extending upwardly as at 57, for supporting a golf ball 59. If desired, the portions 51, 53, 55, and 57 could all be made integrally, but it is preferred to make them of two components fastened together, so that the component 55, 57 can be made of somewhat resilient and flexible material which might be bent, but not seriously damaged, if accidentally hit by the golf club, while the component 51, 53 may be made of stiffer or more rigid material, such as a hard plastic material. Preferably the guiding stem portion 51 is made of material having low-friction properties, or impregnated with such material (e.g., impregnated with molybdenum disulphide) so that it will slide easily upwardly and downwardly in the bore in the top plate 49 of the member 47. This top plate 49 is made relatively thick, so as to have a substantial length acting as a guide channel for the stem 51.

At the top of the outer sleeve 45 of the piston, there are external screw threads mating with internal threads on a cap member 61 which limits the extent to which the tee assembly can rise relative to the piston. This cap member has an upwardly extending collar 63 loosely surrounding the ball supporting shank of the tee assembly as illustrated, this collar portion having an upper edge 65 which is outwardly flared so as to reduce cutting into the ball supporting tee portion 57 when the latter is accidentally hit by the golf club and thrust to one side.

Figure 5:
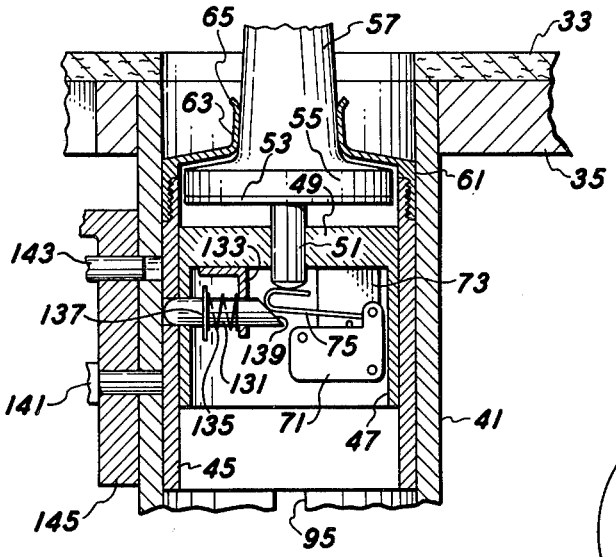
FIG. 5 is a view similar to a fragment of FIG. 4, with the piston in an intermediate position between teed-up and turf positions, illustrating the action of the control member.
Figure 4:
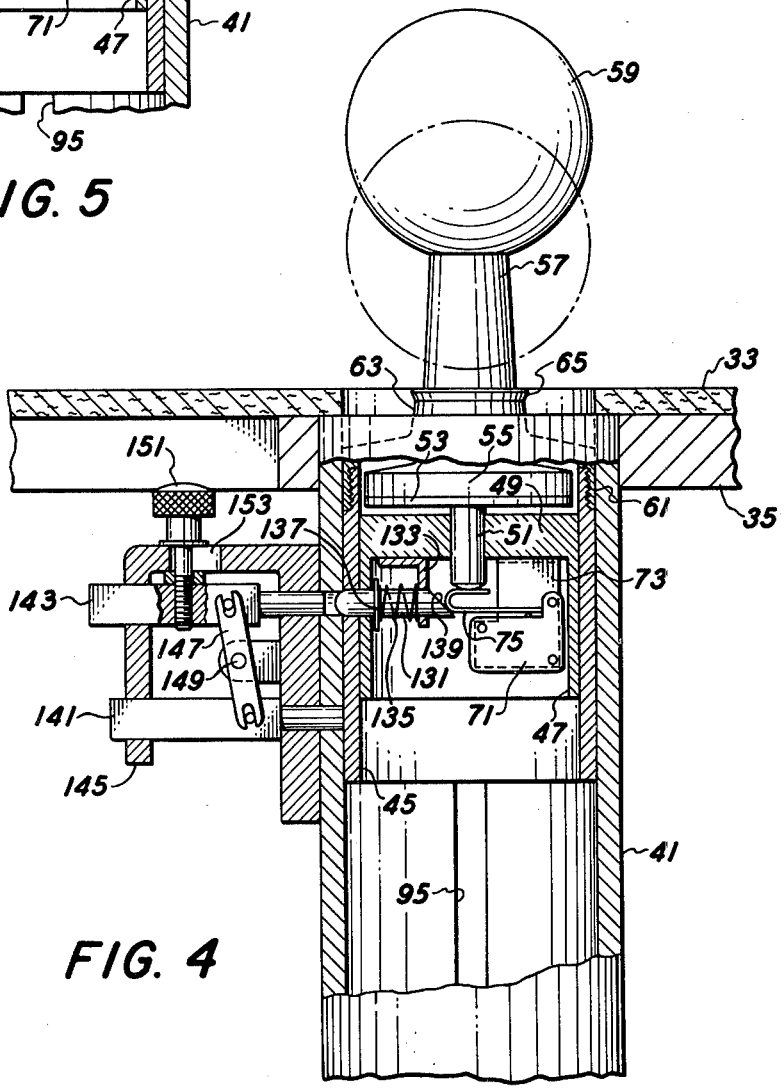
FIG. 4 is a view similar to a fragment of the upper part of FIG. 3, the section being taken on a vertical plane at right angles to the plane of FIG. 3, the ball again being shown in the high or teed-up position, in full lines, with a broken line representation of the location where the ball would be in the low-ball or turf position.

A small snap action microswitch 71 is mounted within the piston, supported by brackets 73 secured to and depending from the underside of the top wall 49. The switch arm 75 of this microswitch is bent back upon itself as best illustrated in FIGS. 4 and 5, and underlies the lower end of the guide stem 51 of the tee assembly. In the conventional manner, the switch arm 75 presses upwardly resiliently. The switch is so wired that when the arm 75 is up, the switch is closed, and when the arm 75 is depressed, the switch is open and the circuit is broken.

The spring tension on the switch arm 75 is such that when a golf ball is resting on the tee support 57, the combined weight of the golf ball and the tee assembly is sufficient to depress the switch arm 75 to its down position, opening the circuit. When the ball 57 is removed, so that its weight is no longer added to the weight of the tee assembly, the weight of the tee assembly alone is insufficient to depress the switch arm, so that the switch arm rises (slightly elevating the tee assembly relative to the piston) and the switch is closed, energizing the motor circuit as further described below.

Through any suitable flexible wires or conductors (not illustrated) the microswitch 71 is connected in the circuit of an electric motor schematically illustrated at 81, preferably having a reduction gear schematically shown at 83, so that the shaft 85 is driven relatively slowly. On this shaft 85 there is a crank arm 87, pivotally connected at 89 to one end of a connecting rod 91, the other end of which is pivotally connected to a pin 93 threaded into one side of the piston assembly. The pin 93 extends radially inward through a vertical slot 95 in the side of the cylinder 41, as illustrated in FIGS. 2 and 3.

Figure 2:
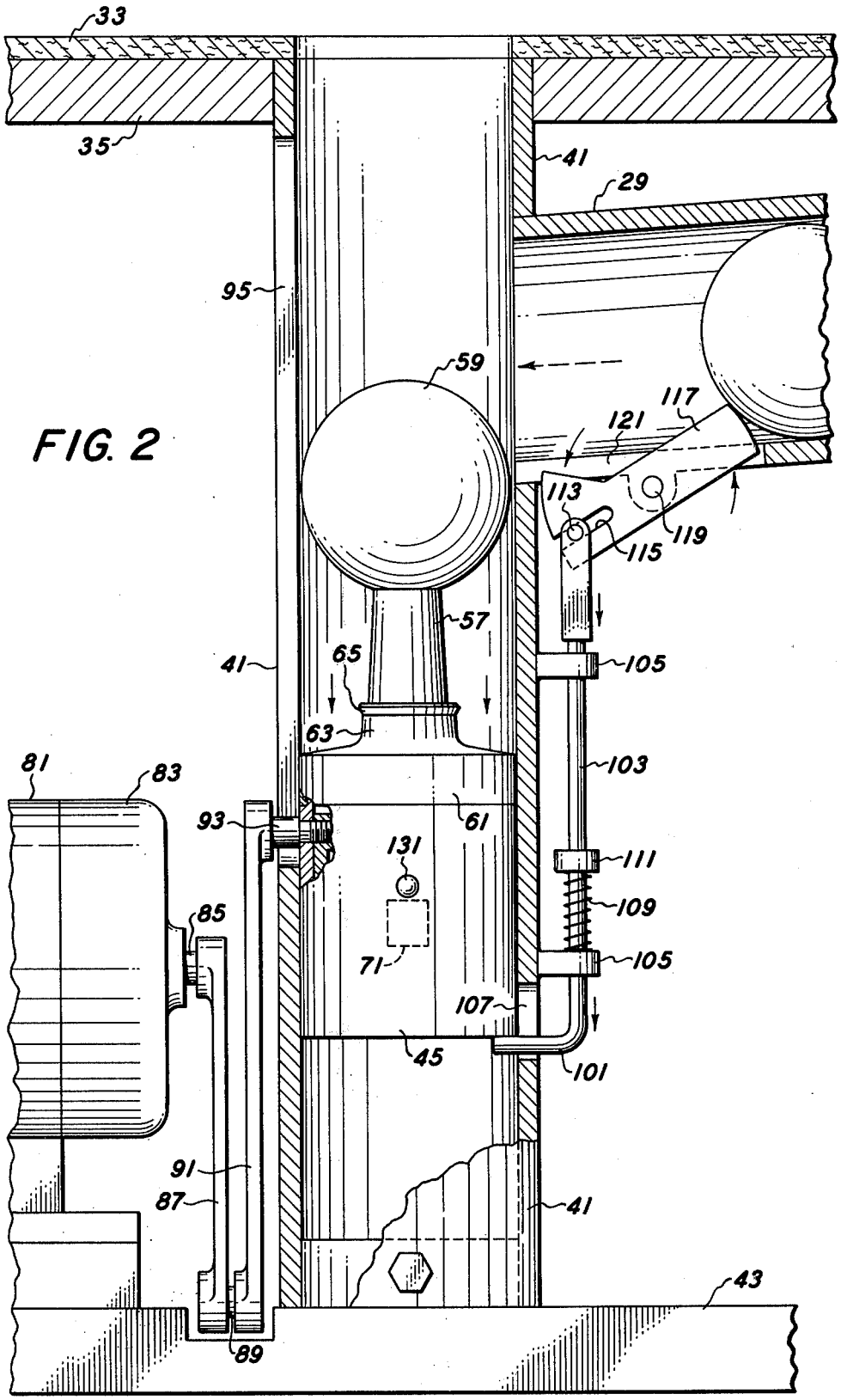
FIG. 2 is a fragmentary vertical section through the main operating part of the apparatus, with the piston in its lowest position, with a fresh ball just having fallen onto the tee members.
Figure 3:
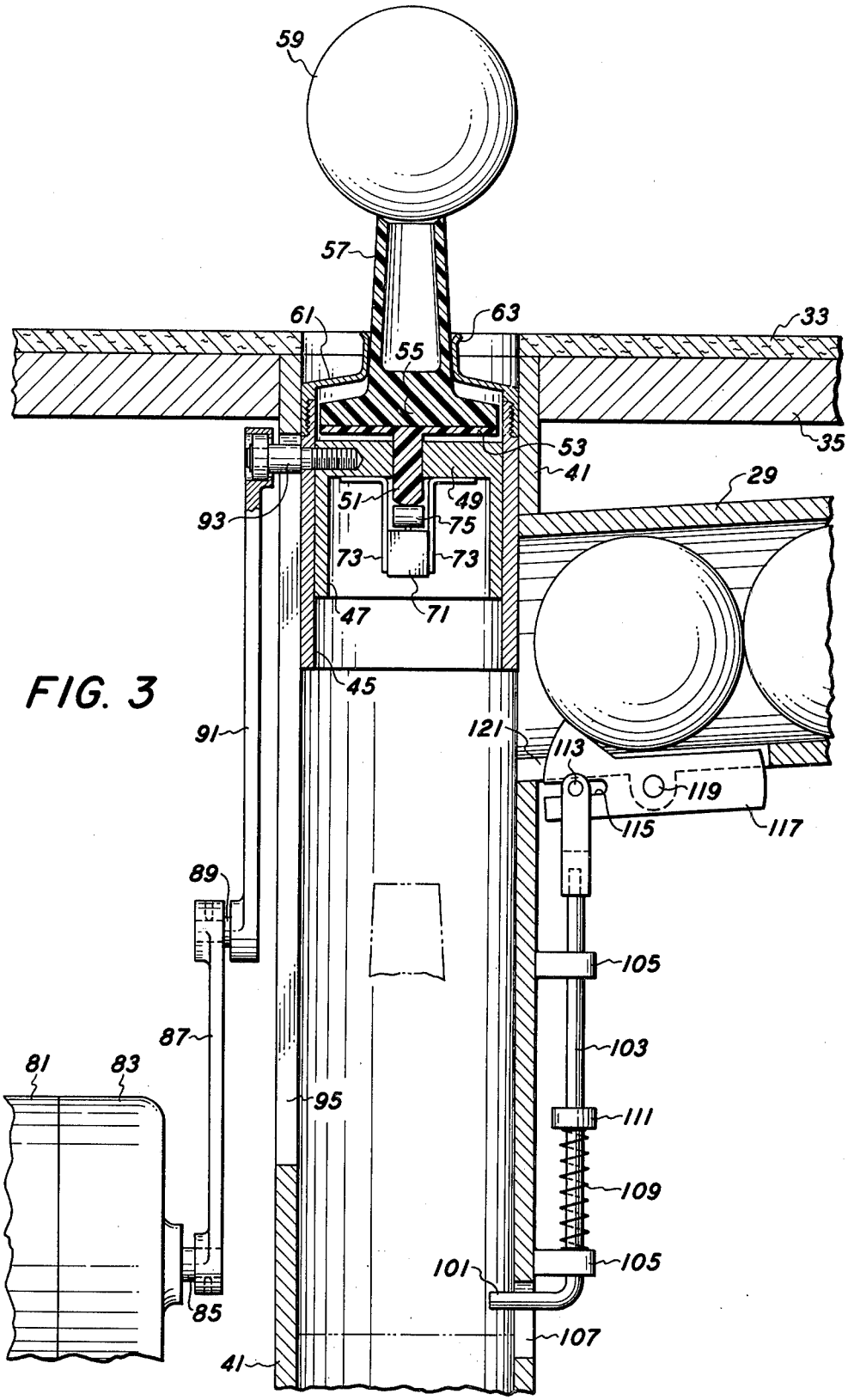
FIG. 3 is a similar fragmentary view with the piston in its uppermost position, with a ball on the tee member in the highest or teed-up position.

As the shaft 85 turns, the action of the crank arm 87 plus the connecting rod 91 serves to move the piston assembly, carrying the tee assembly with it, from it lowest position illustrated in FIG. 2, to its highest position illustrated in FIG. 3. Further motion of the shaft 85 brings the piston assembly and tee assembly down again to the low position. Just before it reaches it lowest position, with the top of the tee member 57 a little below the bottom of the ball supply tube 29, the lower end of the piston engages an arm 101 on a rod 103 mounted for vertical movement in bearings or guides 105 on the outside of the cylinder 41, the arm 101 passing into the interior of the cylinder through a slot 107. A coiled spring 109 reacting downwardly on the lower guide bearing 105 and upwardly on a collar 111 fixed to the rod 103, tends to keep the rod in its uppermost position. The upper end of the rod has a pin 113 engaged in a slot 115 in a ball gate or detent member 117 pivoted at 119 so that the ends of the member 117 may swing upwardly and downwardly through a slot 121 in the bottom of the ball supply tube 29, into ball-obstructing relation to the tube. Initially the next ball in the tube 29 is held by the upwardly extending nose on the left end of the detent member 117, as seen in FIG. 3. As the piston descends, the lower end of the piston engages the arm 101 on the ball release mechanism, depresses this arm against the force of the spring 109, and swings the detent member 117 from the position shown in FIG. 3 to the position shown in FIG. 2. Thereupon the first ball in the tube rolls from the tube into the cylinder 41, and comes to rest on top of the ball support or tee member 57. At the same time, the right hand end of the detent 117 rises through the slot 121, obstructing the second ball in the tube 29 so that it cannot move forward. As the piston moves upwardly, it releases the downward pressure on the arm 101, so that the spring 109 restores the detent 117 to its initial position shown in FIG. 3. The ball previously obstructed by the right end of the detent 117 now rolls a slight distance down the tube until it is obstructed by the nose of the left end of the detent 117, this ball now being in position for feeding into the cylinder at the next cycle of operation.

As already indicated, the present apparatus is capable of elevating the ball either to a low or turf position, or to a high or teed up position. The control mechanism for determining the elevation to which the ball will be raised, will now be described with reference particularly to FIGS. 4 and 5. The same control mechanism also serves to keep the microswitch closed and keep the motor operating from the time that a fresh ball is fed from the tube 29 into the cylinder 41, to the time that the ball is delivered to a location where it may be hit by a golf club, notwithstanding that the weight of the ball during this upward travel from loading position to hitting position would tend to close the switch and stop the motion of the motor, if this control mechanism were not provided.

The control mechanism includes a control plunger 131 mounted for horizontal movement within the piston, guided in an opening in the side wall of the piston and an opening in a bracket 133. A coiled spring reacting rightwardly against the bracket 133 and leftwardly against a washer 137 staked to the control plunger 131, tends to move the control plunger leftwardly when viewed as in FIGS. 4 and 5. The right end of the plunger has an inclined cam surface 139 cooperating with the end of the switch arm 75 as illustrated.

When the control plunger 131 is moved rightwardly, the inclined cam portion 139 rides under the bent end of the switch arm 75 and raises this switch arm sufficiently to keep the switch closed, notwithstanding that the weight of the ball plus the tee assembly is sufficient to depress the switch arm and open the switch if it were not supported in this way by the control plunger 131. The control plunger is held in this position, keeping the switch closed, by the wall of the cylinder 41, the left end of the plunger engaging tight against the cylinder wall.

A recess is provided in the cylinder wall, into which the left end of the plunger can extent, at the point where the vertical movement of the ball is to be stopped. When the plunger can move leftwardly into this recess, the inclinded cam portion 139 is sufficiently withdrawn from the switch arm 75 so that the action of the switch arm then depends on the downward pressure or weight exerted by the stem 51 of the tee assembly, and the switch will be closed by the combined weight of the ball plus the tee assembly, or will be opened as a result of the lesser weight of the tee assembly alone, when no ball is present. Therefore, the control of the elevation to which the ball is brought can be easily effected by providing two recesses in the side wall of the cylinder 41, one at the proper elevation to permit entrance of the control plunger 131 when the ball is at low or turf position, and the other to provide for leftward movement of the control plunger when the ball is at the upper or teed up position, together with mechanism for selectively closing one of these recesses and leaving the other open. This mechanism for determining which of the recesses is to be effective, is illustrated in FIG. 4.

Mounted for horizontal movement in a direction radial with respect to the cylinder 41, there are a lower plunger 141 and an upper plunger 143, guided in holes in a suitable bracket 145. A link 147, pivoted at its center on a fixed pivot 149, has forked ends engaging pins projecting laterally from the plungers 141 and 143, so that as one plunger moves in, the other moves out, and vice versa. A thumbscrew 151 screwed into the top plunger and passing through a slot 153 in the top of the bracket 145, serves to operate the plungers and to hold them in desired position. Shoulders on the plungers control the extent to which they can move radially inwardly with respect to the cylinder 41, the innermost position being one in which the inner end of the plunger is flush with the inner wall of the cylinder, thus effectively eliminating a recess at this point. The outer end of the control plunger 131 simply slides smoothly over the inner wall surface of the cylinder 41 and over the inner end of the recess-closing plunger, just as though no recess existed at this point. When the travel of the piston brings the outer or left end of the control plunger 131 opposite a recess from which the blocking plunger 141 or 143 has been withdrawn, so that the recess is effective, then the rounded left end of the control plunger 131 moves slightly into this recess, just enough to relieve the pressure of the cam portion 139 on the switch arm 75, so that the switch may now be responsive to the weight imposed on it by the stem 51, independently of the control plunger 131.

In FIG. 4, the parts are shown with the lower recess blocked by the plunger 141, and the upper recess effective by withdrawal of the plunger 143. Thus the motor will raise the piston all the way to the top, at which time the control plunger 131 is opposite the upper recess, and the control plunger releases the switch arm 75. A ball is on the tee, at the higher elevation illustrated in full lines in FIG. 4. When the golf club removes the ball from the tee, the lessened weight causes the switch arm 75 to swing upwardly, closing the circuit, starting the motor, and operating the parts through the next cycle.

If the thumbscrew 151 is loosened and moved slightly radially inwardly toward the center of the cylinder 41 and then tightened again, this will move the upper blocking plunger 143 into the upper recess in the side wall of the cylinder, and withdraw the lower blocking plunger 141 from its recess. Then on the next cycle, the driving motor will stop when the control plunger 131 reaches the lower recess and moves slightly into it. The ball will then be in the low or turf position illustrated in broken lines in FIG. 4, so that the golfer may practice turf shots as distinguished from teed up shots. When the ball is hit from this position, the switch will close, and the motor will operate again, raising the piston the slight additional distance to its uppermost position, and then moving the piston downwardly to its lower position to pick up a new ball, and then up again to the low or turf shot position.

Figure 6:
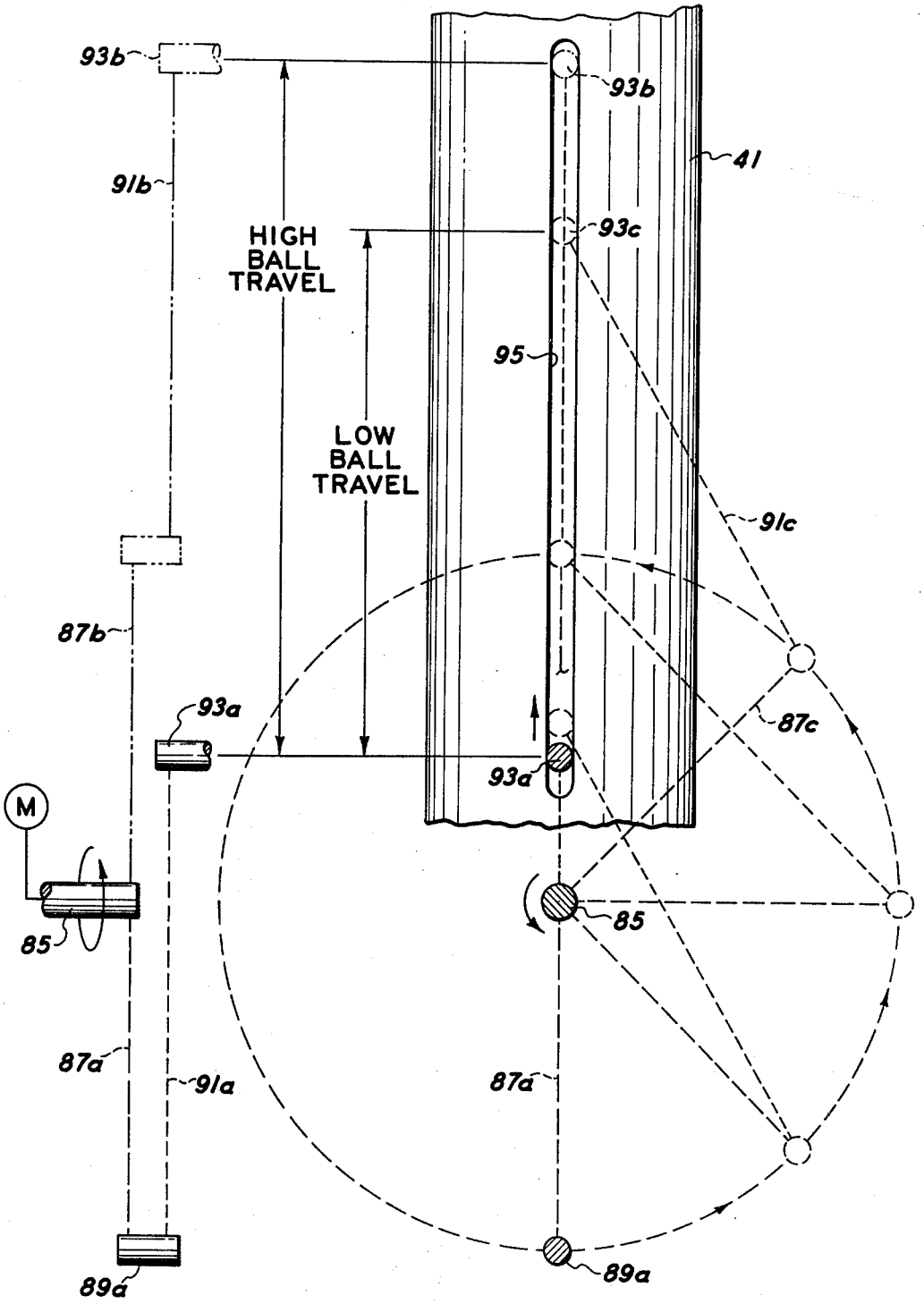
FIG. 6 is a diagrammatic view illustrating various positions of the motor crank arm and connecting rod.

This is illustrated schematically in FIG. 6, where the rotating shaft is indicated as before at 85. The crank arm in the bottom position of the piston is shown at **87*a* and the connecting rod at 91*a*, the pivots 89 and 93 of FIG. 3 being shown at 89*a* and 93*a* in this diagram in FIG. 6. When the shaft 85 rotates through half a revolution, the crank arm will be in the position 87*b*, the connecting rod in the position 91*b*, and the pivot connecting the connecting rod to the piston will be at 93*b*. As the motion continues, the piston will come down again. If the ball is to be placed in the low or turf position, the shaft 85 will stop turning when the crank arm is in the position shown at 87*c*, with the connecting rod in the position 91*c*, and the pivot at 93*c***.

The mechanism is relatively simple, contains only few parts easily manufactured and easily serviced to keep them in good working order, and is easily and quickly adjustable to deliver balls either to the low ball or turf position, or to the high ball or teed up position, as determined from time to time by operator. If it is desired to make the adjustment from one mode of operation to the other mode of operation even quicker and easier, so that each golfer may decide for himself which kind of shot he wants to make, the thumbscrew 151 may be eliminated and the plunger 143 may be connected directly to an electric solenoid which, in turn, is controlled by a switch conveniently accessible to the golfer, so that by flipping the switch one way or the other, he may have the ball raised either to the turf position or the teed up position.

Assuming that the ball is at rest in the teed up position, if the golfer now flips the switch so that the solenoid causes the upper blocking plunger 143 to move inwardly and the lower blocking plunger 141 to move outwardly, the inward motion of the upper plunger will shove the control plunger 131 inwardly, and the cam 139 thereon will raise the switch arm 75 and start the motor, which will then start the down stroke of the piston. The down stroke will continue until the control plunger 131 comes opposite the lower aperture, whereupon it will move slightly into this aperture, allowing the weight of the ball to open the switch, stopping the piston travel at this point. Similarly, if the ball is in the lower position at the time the golfer decides to make his next shot from a teed up position, the reverse operation will take place, the control plunger 131 will be shoved inwardly by the inward motion of the lower blocking plunger 141, and the motor will start and will move the piston upwardly until the control plunger 131 is opposite the upper one of the recesses.

Whenever the motor is started, during ordinary operation, while the plunger is in a recess, the rounded end of the control plunger is immediately cammed out of the recess in which it was seated.

What is claimed is:

1. Golf ball positioning apparatus comprising an approximately vertical guideway, a carrier movable upwardly and downwardly along said guideway, a golf ball supporting member mounted on and movable upwardly and downwardly bodily with said carrier, means for moving said carrier between a lower loading position in which a ball may be placed on said supporting member and an intermediate hitting position in which a ball on said supporting means is substantially at a turf reference elevation and a high hitting position in which a ball on said supporting member is at a teed-up elevation higher than said turf reference elevation, an electric switch mounted on and movable bodily with said carrier, said switch having a switch operating member movable between an upper position and a lower position, said switch operating member being biased upwardly toward its upper position and being arranged to be depressed to its lower position by the combined weight of said ball supporting member and a ball carried thereon, the weight of said ball supporting member alone without a ball thereon being insufficient to depress said switch operating member from its upper position to its lower position, driving means controlled by said switch for moving said carrier along said guideway while said switch operating member is in its upper position and for discontinuing movement thereof along said guideway while said switch operating member is in its lower position, and control means for holding said switch operating member in its upper position to cause operation of said driving means notwithstanding presence of a ball on said supporting member tending to depress said switch operating member to its lower position.

2. The invention defined in claim 1, wherein said control means is effective to maintain said switch operating member in its upper position from the time a ball is removed from said ball supporting member to the time that said driving means has moved said carrier down to loading position and then up to a selected one of said hitting positions.

3. The invention defined in claim 2, wherein said control means comprises a cam member mounted on and movable bodily with said carrier, and a cooperating portion of said guideway for engaging said cam member, the cooperating portion of said guideway being shaped to hold said cam member in a position to maintain said switch operating member in its upper position except when said carrier is in a selected one of its hitting positions and in a position releasing said switch operating member for operation in response to the combined weight of a ball and said ball supporting member when said carrier is in a selected one of its hitting positions.

4. The invention defined in claim 1, wherein said guideway is a hollow cylinder, said carrier is a piston moving in said cylinder, and said control means includes a control plunger mounted on and movable bodily with said piston and also movable radially with respect to said cylinder and having an outer end engaging said cylinder as said piston moves up and down therein and an inner end engaging said switch operating member to hold said switch operating member in its upper position when said control plunger is moved radially inwardly and to release said switch operating member for possible downward movement when said control plunger is moved radially outwardly, and a recess in a wall of said cylinder in a position opposite the outer end of said control plunger when said piston is at one of its hitting positions, so that when said piston is in such position, said control plunger may move radially outwardly partly into said recess.

5. The invention defined in claim 4, wherein there are two recesses in said wall of said cylinder, one in a position opposite the outer end of said control plunger when said piston is in its intermediate hitting position and the other in a position opposite the outer end of said control plunger when said piston is in its high hitting position, and means for blocking one of said recesses so that said control plunger cannot move into it, leaving only the other of said recesses effective to receive the plunger.

6. The invention defined in claim 5, wherein said recesses are in the form of radial openings extending through the thickness of a wall of said cylinder and said blocking means comprises two blocking plungers mounted outside of said cylinder for radial movement into said openings until the inner ends of the plungers are flush with the inner surface of the wall of said plunger, and means interconnecting said blocking plungers so that only one of them at a time can be moved into flush position in its respective opening.

7. The invention defined in claim 1, wherein said supporting member is mounted for limited vertical movement relative to said carrier, and wherein said electric switch is a microswitch, and wherein said switch operating member is an arm of said microswitch resiliently urged upwardly and tending to support said ball supporting member in a slightly elevated position with respect to said carrier.

8. The invention defined in claim 1, wherein said driving means includes a rotatable shaft, a crank arm on said shaft, and a connecting rod operatively connecting said crank arm to said carrier.

* * * * *